US007159504B2

(12) United States Patent
Heldmann et al.

(10) Patent No.: US 7,159,504 B2
(45) Date of Patent: Jan. 9, 2007

(54) FIRING MODULE

(75) Inventors: Heinrich Heldmann, Kassel (DE); Michael Kohlstedt, Immenhausen (DE)

(73) Assignee: Krauss-Maffei Wegmann GmbH & Co. KG (DE)

( * ) Notice: Subject to any disclaimer, the term of this patent is extended or adjusted under 35 U.S.C. 154(b) by 2 days.

(21) Appl. No.: 10/530,787

(22) PCT Filed: Nov. 8, 2003

(86) PCT No.: PCT/DE03/03708

§ 371 (c)(1),
(2), (4) Date: Apr. 8, 2005

(87) PCT Pub. No.: WO2004/055464

PCT Pub. Date: Jan. 7, 2004

(65) Prior Publication Data

US 2006/0162541 A1 Jul. 27, 2006

(30) Foreign Application Priority Data

Dec. 13, 2002 (DE) ..... 102 58 263

(51) Int. Cl.
*F41A 9/00* (2006.01)

(52) U.S. Cl. ..... 89/45; 89/46; 89/47; 89/33.05

(58) Field of Classification Search ..... 89/45, 89/46, 47, 33.05, 33.04, 36.08
See application file for complete search history.

(56) References Cited

U.S. PATENT DOCUMENTS

| | | | | |
|---|---|---|---|---|
| 4,706,544 | A * | 11/1987 | Zielinski et al. | 89/46 |
| 4,823,675 | A * | 4/1989 | Schiele et al. | 89/46 |
| 4,947,728 | A * | 8/1990 | Muhlhausen et al. | 89/46 |
| 6,591,733 | B1 * | 7/2003 | Engstrom | 89/45 |
| 6,752,063 | B1 * | 6/2004 | Panek et al. | 89/46 |
| 6,769,344 | B1 * | 8/2004 | Domeij | 86/46 |

* cited by examiner

*Primary Examiner*—J. Woodrow Eldred
(74) *Attorney, Agent, or Firm*—Robert W Becker & Associates; Robert W. Becker

(57) ABSTRACT

A firing module having a fully automatic shell supply mechanism for supplying shells to a heavy weapon in a housing. A shell ram having a loading tray is disposed on a free end of a shell transfer arm that is pivotable between a raised position, in which the loading tray is aligned with the gun bore axis, parallel to a plane of elevation, and a lowered position, in which the tray is essentially vertical. A gripping mechanism on a shell transport arm grasps a vertical shell stored in at least one ammunition magazine for supplying a shell from a shell transporter, to the loading tray, in the lowered position of the shell transfer arm. The ammunition magazines and transporter are disposed in the housing ahead of a trunnion. The loading tray is pivotable about a pivot axis, which is essentially vertical in the lowered position of the shell transfer arm, by at least 180° between a receiving position opening ahead of the trunnion, and a delivery position opening behind the trunnion. At least one propellant charge magazine is disposed in the housing next to or behind the trunnion. A fully automatic propellant charge supply mechanism is disposed in the housing for supplying propellant charges to the weapon, and has a propellant charge supply tray pivotable into a region behind the weapon and in alignment with the gun bore axis.

11 Claims, 10 Drawing Sheets

W
4.2
4.1
6
1
2
3
27.2
27.1
T1
T2
T3
T4
24.22
24.21
28.3
28.2
28.1
27.11

37.1
1
9.2
W
38.2
3
37.2
2
9.1
5
38.1
5.1
5

FIRING MODULE

This specification for the instant application should be granted the priority date of Dec. 13, 2002, the filing date of the corresponding German patent application 102 58 263.7 along with the priority date of Nov. 8, 2003, the filing date of the International Patent Application PCT/DE203/003708.

BACKGROUND OF THE INVENTION

The present invention relates to a firing module having a housing that can be mounted on a carrier structure so as to be rotatable in azimuth and in which a heavy weapon is mounted so as to be pivotable in elevation about a trunnion, whereby shells are supplied to the weapon via a shell supply mechanism that operates fully automatically and that is provided with a shell transfer arm that is pivotably mounted on the trunnion and on the free end of which is disposed a shell ram having a loading tray and that is pivotable out of a raised position, in which the loading tray is aligned with the gun bore axis of the weapon, parallel to the plane of elevation, into a lowered position, in which the loading tray is essentially vertical, as well as a shell transporter having a transport arm that on its free end is provided with a gripping mechanism for grasping a respective shell that is vertically stored in an ammunition magazine, tip pointing upwardly, and for supplying the shell from the shell transporter, to the loading tray, in the lowered position of the shell transfer arm.

A device of this type, in an embodiment as an armored howitzer, is described in European patent EP 0 331 980 B1.

With the known armored howitzer, the housing is embodied as a rotatable turret on which the heavy weapon is disposed. The turret, which is rotatable in azimuth, rests upon a carrier structure that is embodied as a tracked vehicle. With the known device, the ammunition magazines are disposed below the rotary bearing in the hull of the carrier vehicle, and the shells are grasped by the shell transporter and initially deposited in a transport rail that is also disposed in the vehicle hull and is initially horizontal. The transport rail moves the respective shell linearly and rotates about the vertical axis to adjust the various possible turret positions relative to the undercarriage. After reaching the turret position, the transport rail raises the horizontal shell into a vertical position and transfers it into the loading tray of the ram. The shell transfer arm is then pivoted upwardly about the trunnion axis until the loading tray of the shell ram is aligned with the gun bore axis of the weapon. With the known device, the propellant charges are manually supplied to the weapon.

It is an object of the invention to embody a firing module of the aforementioned type in such a way that a considerable saving in installation space, especially overall height, and in weight are achieved, and furthermore that the construction of the shell supply mechanism is simplified. The firing operation should be fully automatic, so that it could, for example, also be carried out from a command station externally of the firing module itself, and the firing module should have many applications, i.e. it should be possible for the carrier structure to be not only a tracked vehicle but also a wheeled vehicle for roads or rails, and also a fixed structure or even a ship.

SUMMARY OF THE INVENTION

The realization of this object is inventively effected in that the firing module has the following features:

a) at least one ammunition magazine as well as the shell transporter are disposed in the housing ahead of the trunnion;

b) the loading tray, on the shell transfer arm, is pivotable about a pivot axis, which in the lowered position of the shell transfer arm is essentially vertical, by at least 180° between a receiving position, which opens to the region ahead of the trunnion, and a delivery position, which opens to the region behind the trunnion;

c) at least one propellant charge magazine is disposed in the housing in the region next to or behind the trunnion;

d) propellant charges are supplied to the weapon via a propellant charge supply mechanism that is disposed in the housing, operates fully automatically, and is provided with a propellant charge supply tray that has a propellant charge ram and is pivotable into the region behind the weapon and in alignment with the gun bore axis of the weapon.

Advantageous further developments of the invention will be described subsequently.

The basic concept of the invention is to dispose not only the ammunition magazines but also the fully automatically operating shell supply mechanism in the same housing above a rotary bearing, in which housing additionally all of the propellant charge magazines as well as a fully automatically operating propellant charge supply mechanism are accommodated. In this connection, there is effected a clear separation of the ammunition magazines from the propellant charge magazines and the shell supply mechanism from the propellant charge supply mechanism. In so doing, there result very short paths for the transfer not only of the shells but also of the propellant charges to the weapon, which enables a high firing sequence frequency.

Weapon, shell transfer arm and the ammunition magazine with the shell transporter thus form a unit, the firing module, that is disposed above the rotary bearing. The transport rail that is required with the known device is eliminated, thus simplifying the shell supply mechanism and reducing the weight. Due to the elimination of the transport rail, the overall height of the firing module is also reduced. To enable a fully automatic firing operation, the shell supply mechanism is supplemented with a propellant charge supply mechanism that operates fully automatically.

The inventive firing module permits a separation of the gun operating personnel from the weapon, aiming mechanism, shell supply mechanism, propellant charge supply mechanism, and the ammunition. In so doing, the ballistic protective structure that is present with the known device is limited to the protective space of the personnel, and hence of the command station.

With this measure, the overall weight of a gun that comprises a slightly protected firing module and an optimally protected command station, can be brought to a weight, while extensively maintaining the other gun characteristics (firing power, range, cadence, automation), that enables air transport with smaller and middle sized transport aircraft.

The full automation furthermore permits the reduction of operating personnel, which again leads to a reduced danger to personnel during use and in peacetime operation.

By separating operating personnel and the firing module, the number of personnel can be reduced to a minimum, and the personnel can be protected with an optimal ballistic protective structure. Furthermore, the overall weight of the gun is minimized.

Furthermore, the separation of personnel and firing module in the manner described permits new loadingconcepts, since space can be utilized that up to now had to be kept free for the gun operating personnel. Higher voltages can be used for the electrical drives, and hence weight and cost reductions and/or increases in power are achieved. Furthermore, the expense for air conditioning and ABC protection ventilation is less, since now only a relatively small command station space has to be assessed. Improvement of the protection of the personnel is achieved by the spatial separation and partitioning by bulkheads from the ammunition that is taken along and from weapon aiming and loading movements.

With the inventive firing module, the firing operation can be carried out fully automatically, and it can be operated from a location externally of the housing, in other words, for example, even from a command station set up in the countryside or from the driver's cab of a carrier vehicle. As will be described in greater detail subsequently with the aid of specific embodiments, the propellant charge magazines and the propellant charge supply mechanism can be embodied in such a way that variously sized propellant charges can be freely selected and supplied. A particularly rapid availability of the propellant charges is achieved, if, as described below, two propellant charge magazines that are independent of one another, and two propellant charge supply mechanisms, are disposed in the housing.

BRIEF DESCRIPTION OF THE DRAWINGS

Specific embodiments for an inventive firing module are explained in detail in the following with the aid of the accompanying drawings.

The drawings show.

DESCRIPTION OF SPECIFIC EMBODIMENTS

The firing module illustrated in FIGS. 1 to 6 has a housing 1 that is mounted so as to be rotatable in azimuth, via a rotary bearing 2, on the chassis of a carrier vehicle T that is embodied as a tracked motor vehicle.

Figure 1:
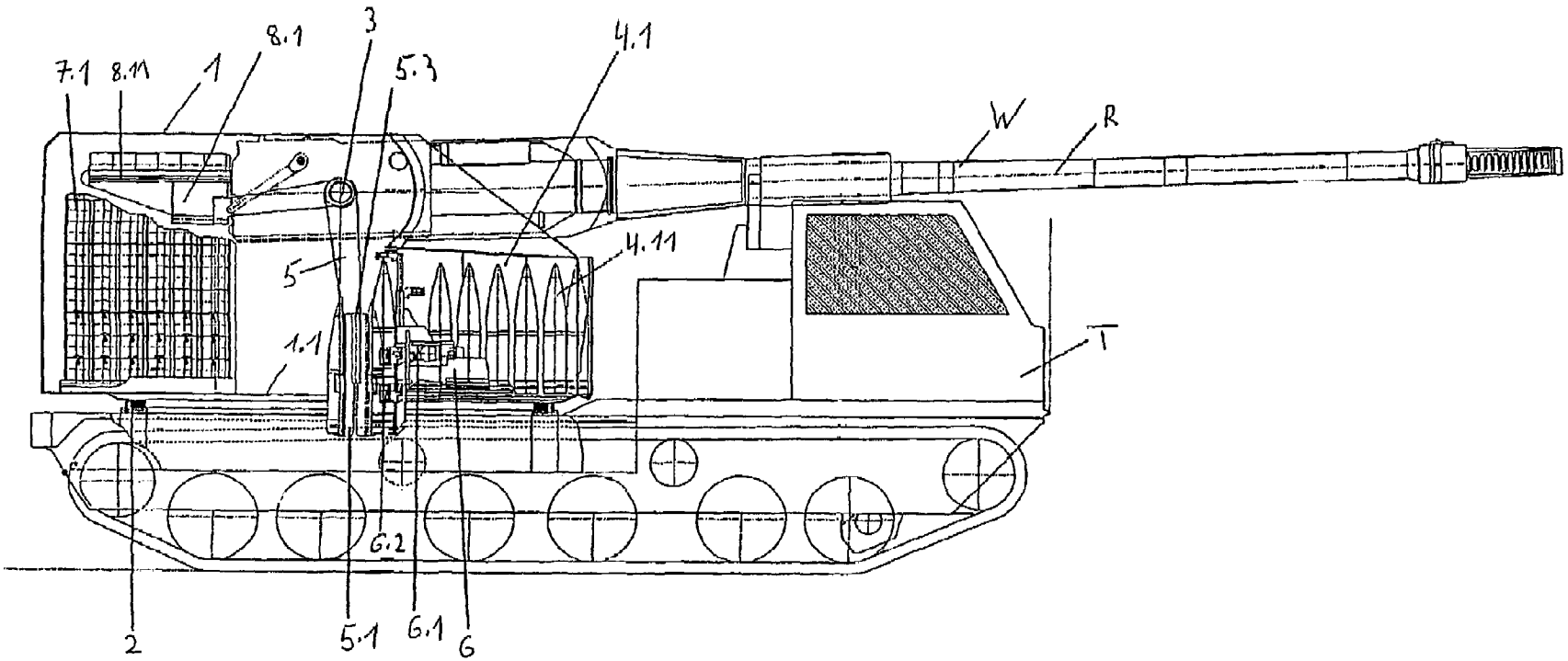
FIG. 1 in a partially sectioned side view, a firing module in a carrier vehicle embodied as a tracked vehicle.
Figure 3:
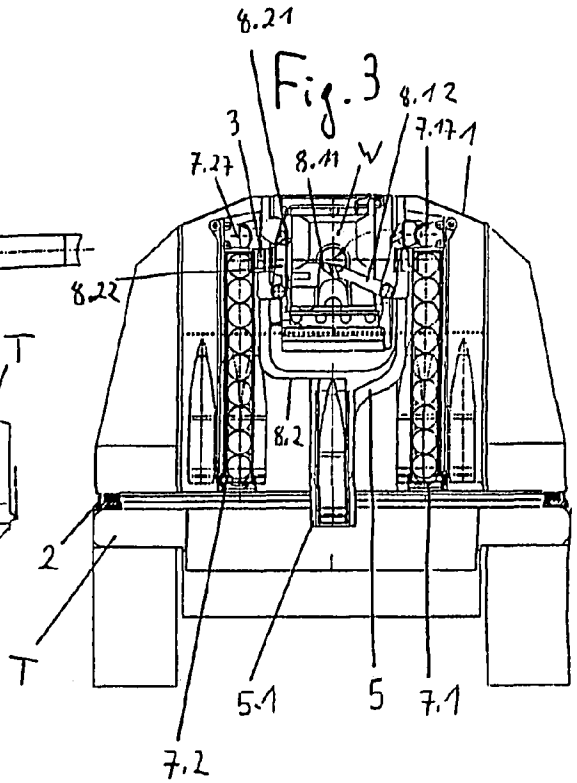
FIG. 3 the firing module of FIG. 1 in a partially sectioned rear view.
Figure 2:
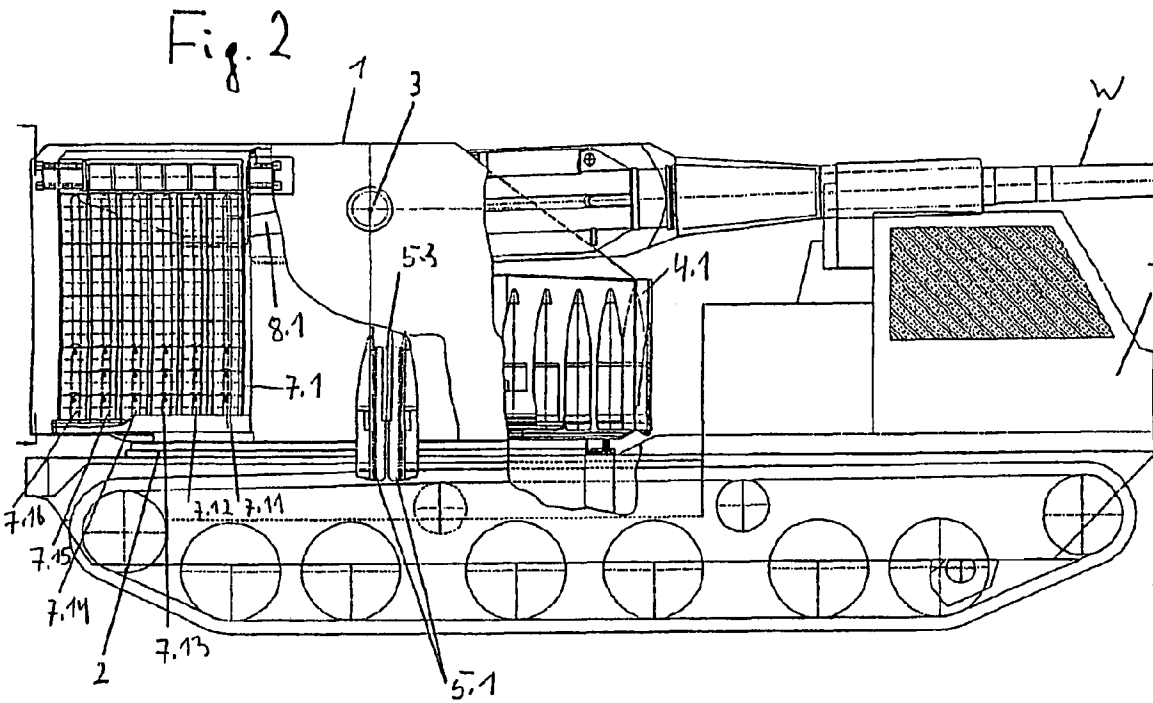
FIG. 2 in a partial illustration analogous to FIG. 1, the firing module of FIG. 1 with further details.
Figure 4:
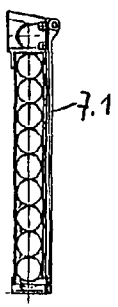
FIG. 4 a rear view of a propellant charge magazine of the firing module of FIGS. 1 to 3.
Figure 5:
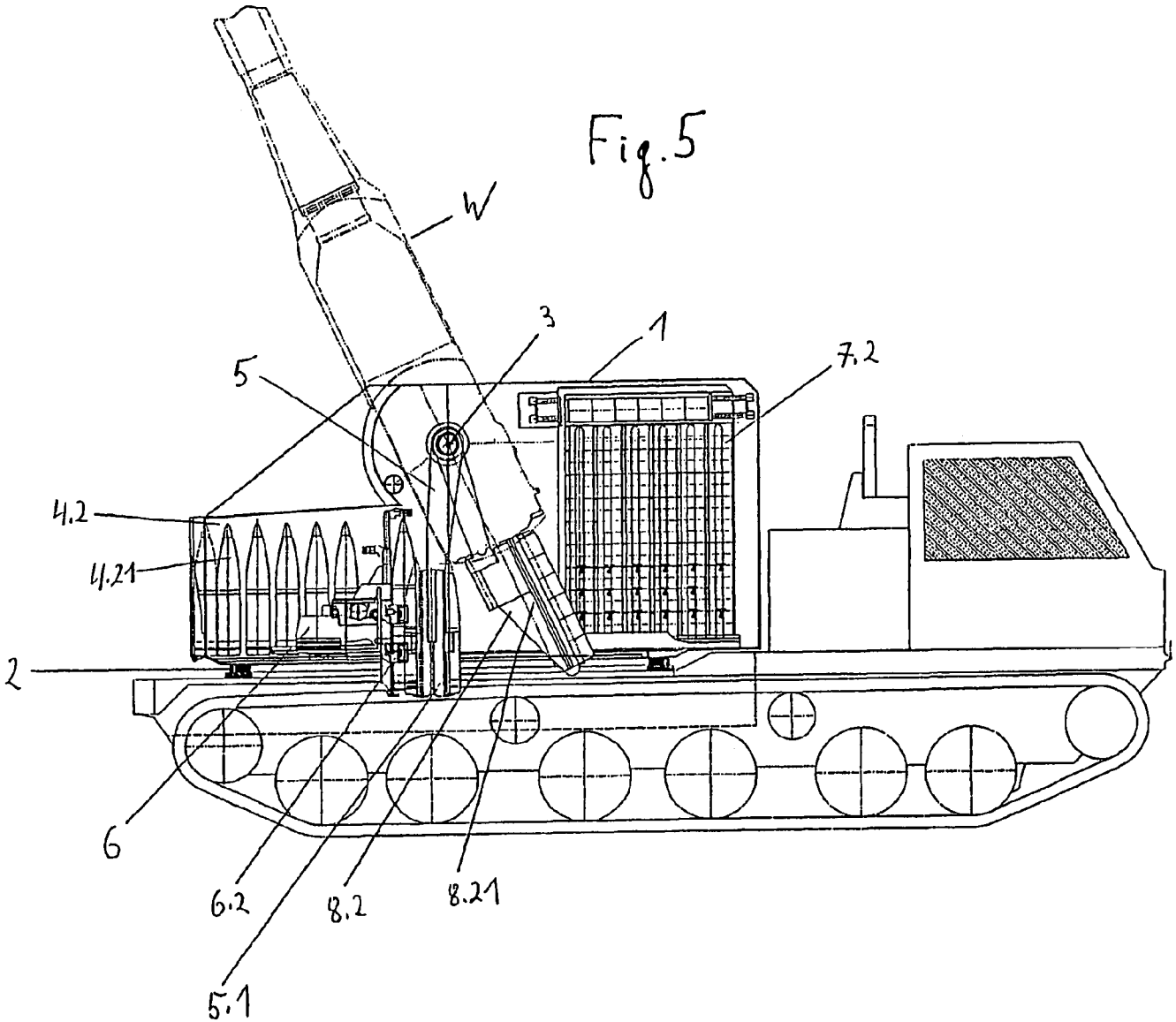
FIG. 5 a side view of the firing module of FIGS. 1 to 4 in a position rotated on the carrier vehicle by 180° in azimuth, and with the weapon raised.
Figure 6:
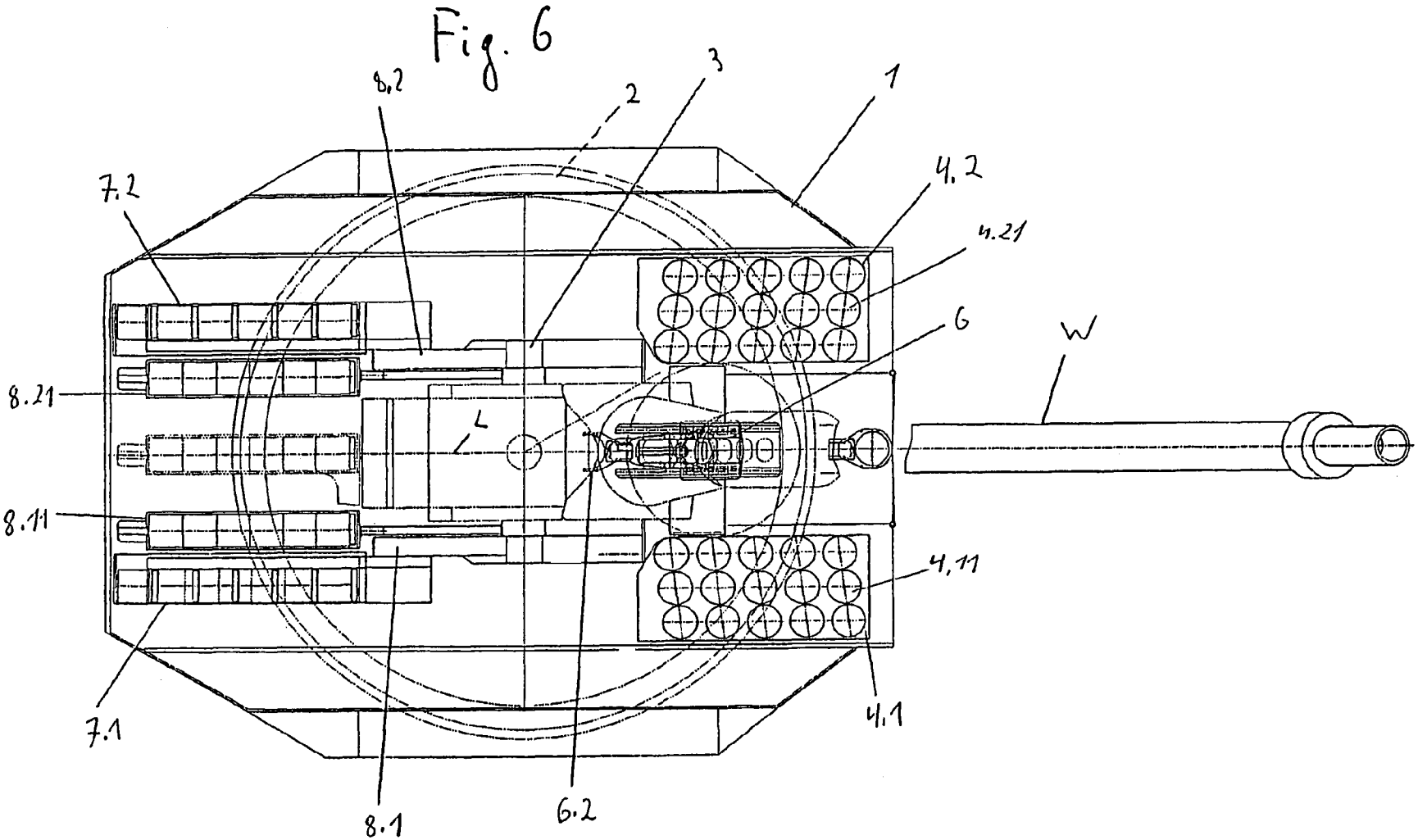
FIG. 6 the firing module of FIGS. 1 to 5 in a partially sectioned view from above.

In the housing 1, a heavy weapon W is supported so as to be pivotable in elevation about a trunnion 3. In the forward portion of the housing 2, in the region ahead of the trunnion 3, on both sides of the longitudinal central axis L (FIG. 6) of the housing, two ammunition magazines 4.1 and 4.2 are disposed in which are arranged shells 4.11 and 4.21 in a vertical orientation with upwardly directed tips. Out of these ammunition magazines 4.1 and 4.2, the shells are conveyed to into region behind the weapon W via a shell supply mechanism that operates fully automatically. This shell supply mechanism has a shell transfer arm 5 that is pivotably mounted on the trunnion 3 and on the rear, free end of which is disposed a loading tray 5.1 of a non-illustrated shell ram. The shell transfer arm 5 can be pivoted out of a raised, non-illustrated position, in which the loading tray 5.1 is aligned with the gun bore axis R of the weapon W, parallel to the elevation plane, into a lowered position that can be seen in FIGS. 1 and 3, and in which the loading tray is oriented essentially vertically, i.e. perpendicular to the housing base 1.1. As can be seen in FIGS. 1 and 2, the loading tray 5.1 is pivotable about a pivot axis 5.3, which is vertically oriented in the lowered position of the shell transfer arm 5, by 180° between a receiving position, which opens to the region ahead of the trunnion 3, and a delivery position, which opens to the region behind the trunnion 3. In FIGS. 1 and 3, loading tray, and a shell disposed therein, are illustrated by dotted lines in both positions. The shell supply mechanism is furthermore provided with a shell transporter 6, which is disposed in the region between the ammunition magazines 4.1 and 4.2. In a manner known per se, the shell transporter 6 has a transport arm 6.1 that is provided on its free end with a gripping mechanism 6.2 that is equipped with two grippers and via which a respective shell 4.11 or 4.21, which is stored in one of the ammunition magazines 4.1 or 4.2, is grasped and is supplied by the shell transporter 6 to the loading tray 5.1 in the lowered position of the shell transfer arm 5. The loading tray 5.1 is then pivoted by 180° about the axis 5.3. The shell transfer arm 5 is then pivoted upwardly into the raised position, and the shell is supplied to the weapon W by the shell ram.

In the embodiment of FIGS. 1 to 6, disposed in the region behind the trunnion 3 are two propellant charge magazines 7.1 and 7.2 that are embodied for receiving modular propellant charges. As can be seen from the figures, the propellant charge modules are vertically disposed one above the other in compartments 7.11, 7.12, 7.13, 7.14, 7.15 and 7.16 from which they are cyclically conveyed upwardly, by non-illustrated conveying devices, and are delivered at the upper end. The propellant charges are conveyed by a propellant charge supply mechanism, which operates entirely automatically, from the magazines to the weapon, and are supplied to the latter. In the illustrated embodiment, the propellant charge supply mechanism is provided with two propellant charge transfer arms 8.1 and 8.2 on which are respectively disposed a propellant charge supply tray 8.11 and 8.21 respectively. In this connection, the propellant charge supply trays are secured to pivot arms 8.12 and 8.22 and are disposed on the propellant charge transfer arm 8.1 and 8.2. As can be seen by way of example in FIG. 3, the propellant charge modules are supplied to the propellant charge supply tray 8.11 or 8.21 at the upper end of the propellant charge magazine in a position of the pivot arm 8.12 or 8.22 that is pivoted toward the propellant charge magazine. A respective pivot arm 8.12 or 8.22 is then pivoted inwardly about an axis that, possibly after an appropriate pivoting of the propellant charge transfer arm 8.1 or 8.2, is parallel to the gun bore axis R of the weapon, until the respective propellant charge supply tray—in FIG. 3 by way of example the propellant charge supply tray 8.11—is aligned with the gun bore axis R behind the weapon. In this position, the propellant charge modules, via a non-illustrated propellant charge ram, which can, for example, be embodied as a chain that is rigid on the top, are supplied to the charge compartment of the weapon W. With this type of supply of the propellant charges, it is possible to remove from one of the propellant charge magazines 7.1 or 7.2 exactly the number of propellant charge modules that are required for the pertaining firing. In the illustrated embodiment, it is possible to remove from each magazine, for each firing, a maximum of six propellant charge modules that are placed together in the propellant charge supply tray and are supplied together. By providing two independent propellant charge magazines 7.1 and 7.2, and two propellant charge supply mechanisms, it is possible to rapidly make available the propellant charges behind the weapon.

Due to the precise apportionment of the desired number of propellant charge modules during the automatic supply, no balance or remainder of propellant charge modules remains behind, as is generally the case during the manual supply if propellant charge modules are used that are present in six packs.

Depending upon the construction of the propellant magazines and the supply mechanisms, it can also be possible to convey and supply propellant charges having different lengths.

Since the two propellant charge magazines 7.1 and 7.2 are fixedly connected with the housing 1, the propellant charge transfer arms 8.1 and 8.2 serve for the reliable supply in varying elevational positions of the weapon W.

The described firing module is extremely variable with respect to the arrangement and configuration of the ammunition magazines and the propellant charge magazines.

Figure 7:
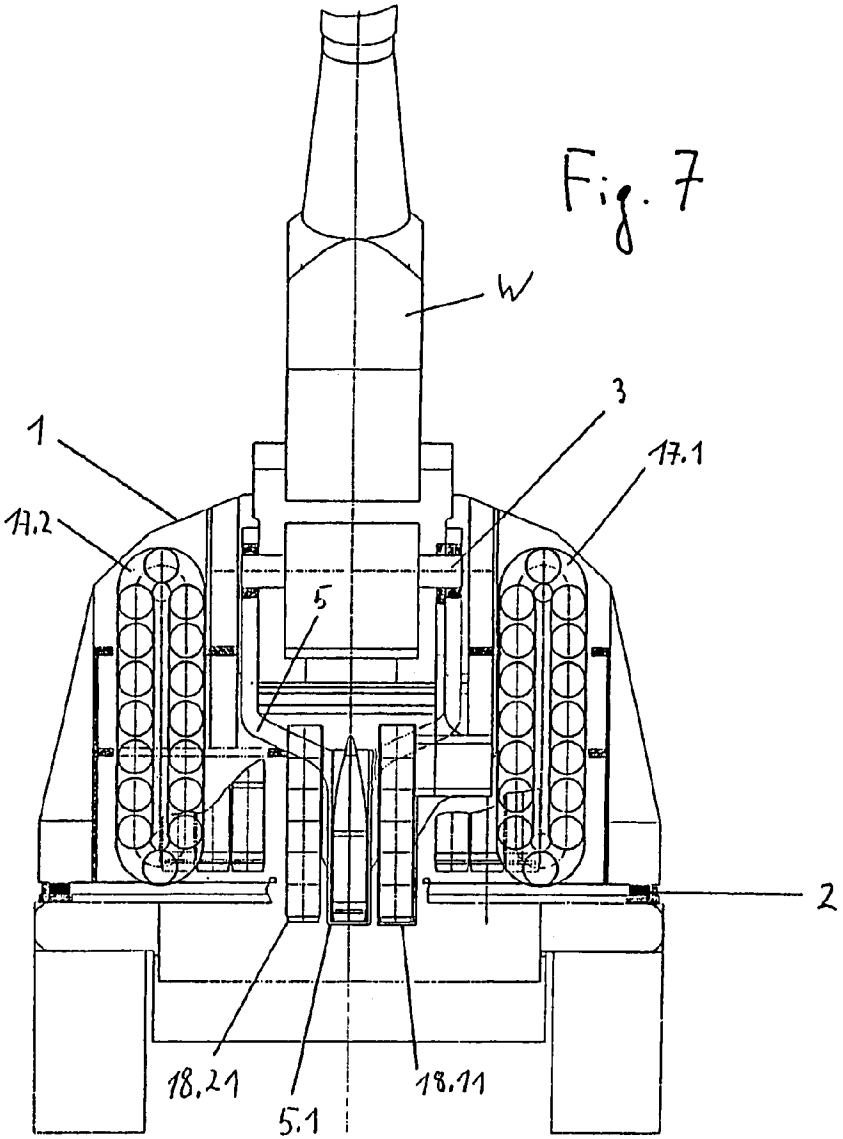
FIG. 7 a variation of the firing module of FIGS. 1 to 6 in a partially sectioned rear view with propellant charge magazines embodied as band magazines.

FIG. 7 shows an embodiment where the propellant charge magazines 17.1 and 17.2 are again fixedly disposed in the housing 1, but are embodied not as compartment magazines but rather as band magazines. Here also the propellant charge modules are supplied to propellant charge supply trays 18.11 and 18.21, which, in the manner already described, can be pivoted rearwardly behind the weapon out of the region of the propellant charge magazines. In the remaining respects, the embodiment of FIG. 7 is embodied exactly as the embodiment of FIGS. 1 to 6.

Figure 8:
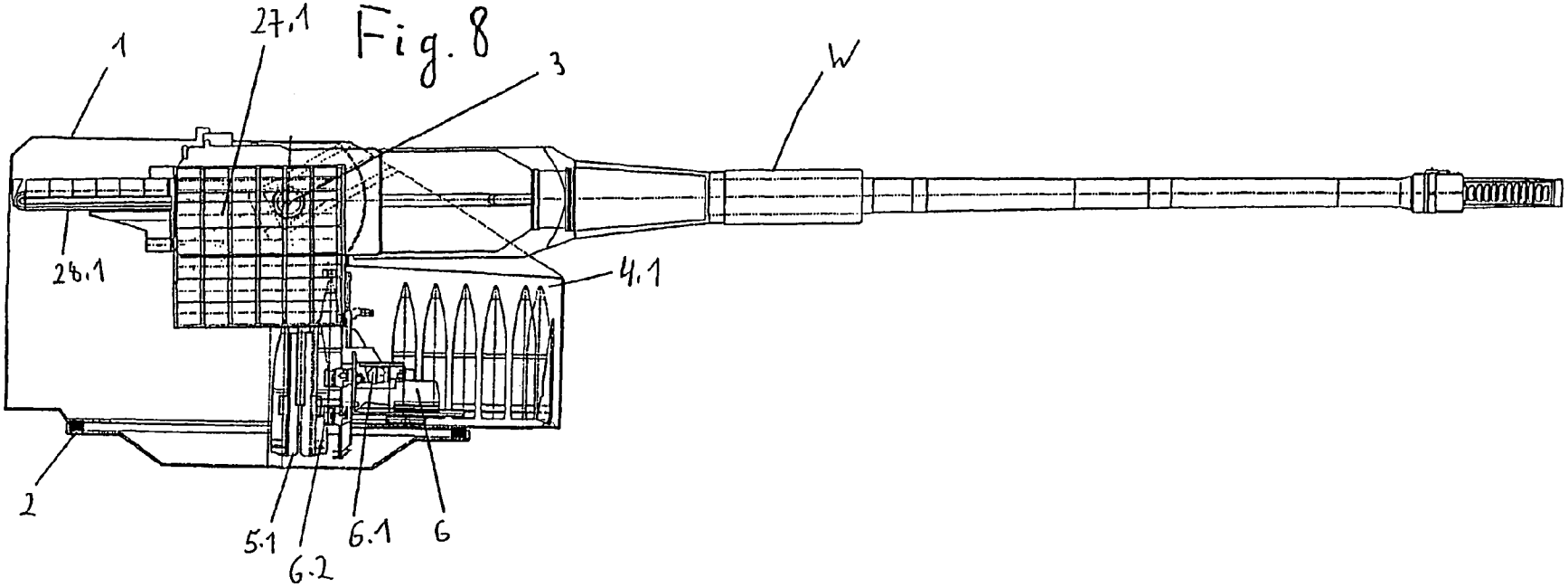
FIG. 8 a further embodiment of the firing module in a partially sectioned side view with propellant charge magazines fixedly disposed on the weapon.
Figure 9:
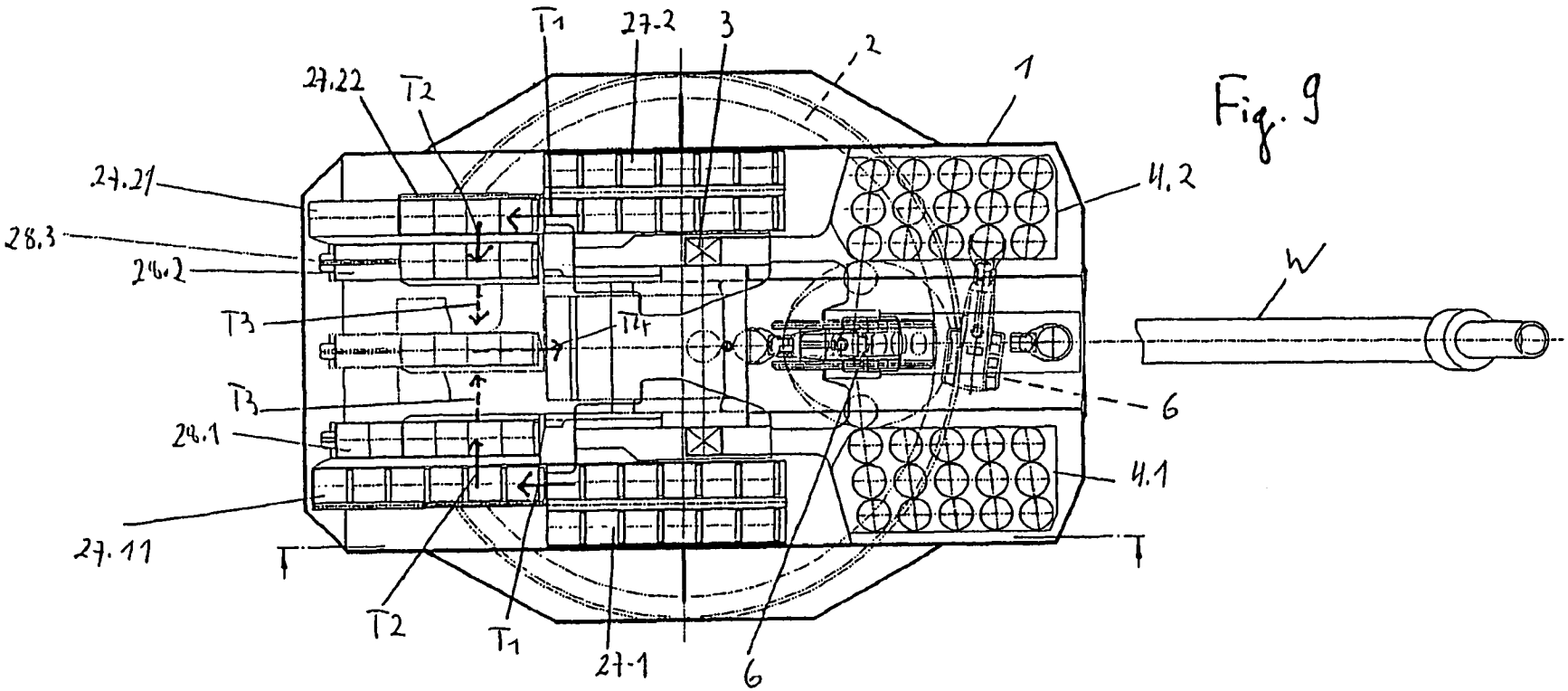
FIG. 9 the firing module of FIG. 8 in a partially sectioned view from above.
Figure 10:
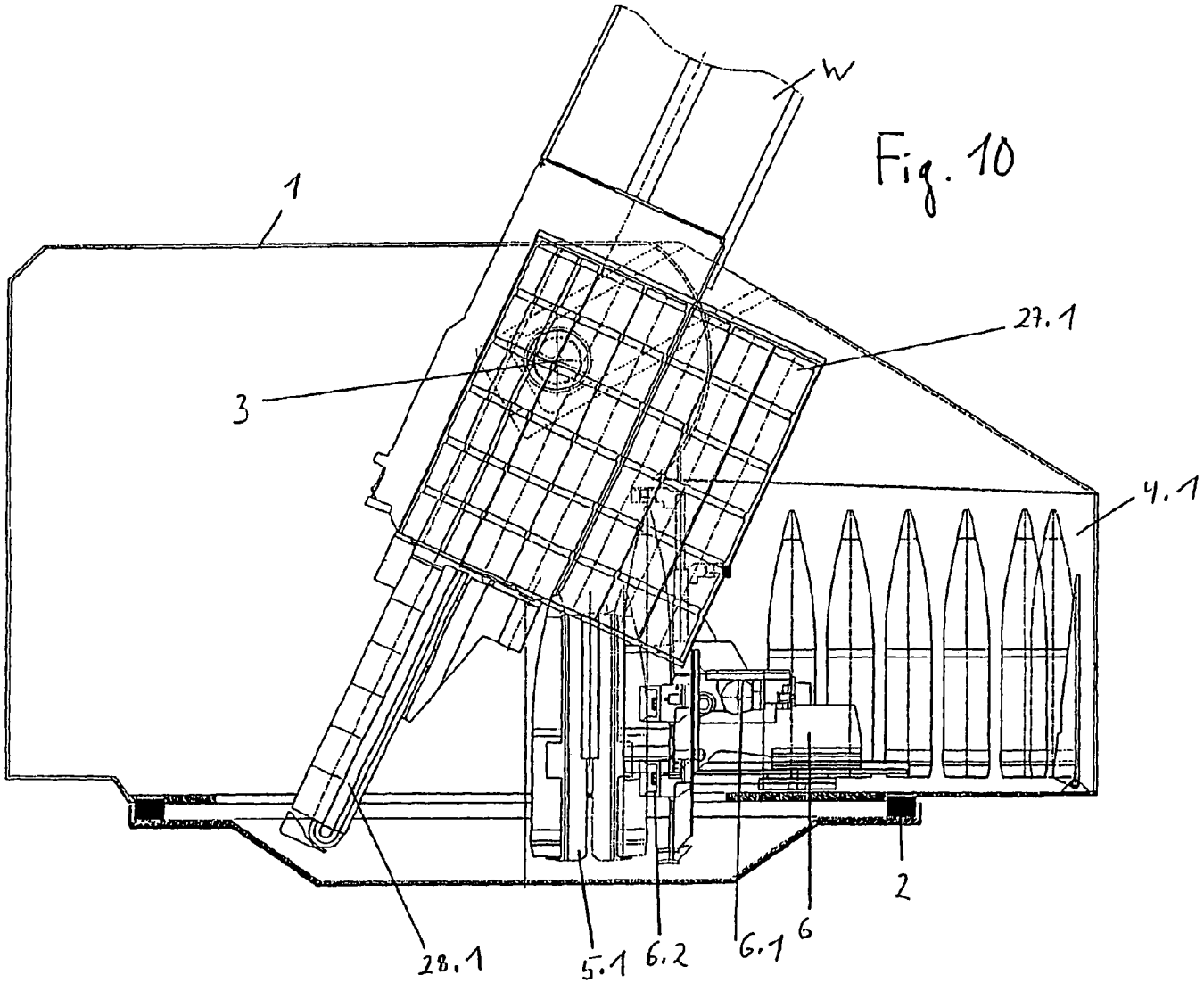
FIG. 10 the firing module of FIGS. 8 and 9 in a partially sectioned enlarged partial illustration, with the weapon raised.

FIGS. 8 to 10 show an embodiment of the firing module where the propellant charge magazines 27.1 and 27.2, which are embodied as compartment magazines, are fixedly connected not with the housing 1, but rather with the weapon W, and thus execute along with the weapon the pivoting movement during the elevation. As a result, the propellant charge modules, which are supplied to the propellant charge supply trays 28.1 and 28.2 from the propellant charge magazines 27.1 and 27.2, are already disposed at the correct elevational angle and need only to be pivoted inwardly behind the weapon by a device that corresponds to the pivot arms 8.12 and 8.22 from FIG. 3. Propellant charge transfer arms are not required with this embodiment. Rather, the propellant charges from the propellant charge magazines 27.1 and 27.2 are initially respectively supplied to an apportioning station 27.11 or 27.21, and are then transferred to the propellant charge supply trays 28.1 or 28.2, from where they are supplied to the charge compartment of the weapon W, after the pivoting in, via a propellant charge ram 28.3. As can be seen in FIG. 9, depending upon the shell that is to be made available, a different number of propellant charge modules can be supplied. Thus, for example, the propellant charge supply tray 28.1 contains six propellant charge modules, while the propellant charge supply tray 28.2 contains only four propellant charge modules.

The specification incorporates by reference the disclosure of German priority document 102 58 263.7 filed Dec. 13, 2002 and PCT/DE2003/003708 filed Nov. 8, 2003.

The present invention is, of course, in no way restricted to the specific disclosure of the specification and drawings, but also encompasses any modifications within the scope of the appended claims.

Since with the embodiment illustrated in FIGS. 8 to 10 only a limited space is available toward the bottom for the upward movement of the rear portion of the weapon with the propellant charge magazines disposed thereon as well as the propellant charge supply mechanism, in order to ensure the full elevational range of the weapon the propellant charge magazines 27.1 and 27.2 are disposed more in the vicinity of the trunnion 3. As a result, the propellant charge modules delivered from the propellant charge magazines must be supplied to the weapon along a special path, which is indicated in FIG. 9. As can be seen, the propellant charge modules from the propellant charge magazines 27.1 and 27.2 are initially conveyed into the apportioning stations 27.11 or 27.21 in the direction of the arrow T1. From there, they are transferred to the propellant charge trays 28.1 or 28.2 in the direction of the arrows T2. These trays are then pivoted in behind the weapon in the direction of the arrows T3, and the propellant charges are then supplied by the propellant charge ram to the charge chamber of the weapon in the direction opposite to the arrow T1, namely in the direction of the arrow T4.

The placing together of the propellant charge modules, and possibly the assembly together to form a propellant charge unit, can already be carried out in the apportioning station via a displacement mechanism. This is illustrated in FIG. 9 for the apportioning station 27.21 via the displacement mechanism 27.22. The apportioning station 27.11 is equipped in an analogous manner.

In other respects, the firing module of FIGS. 8 to 10 has the same configuration as does the firing module of FIGS. 1 to 6.

Figure 11:
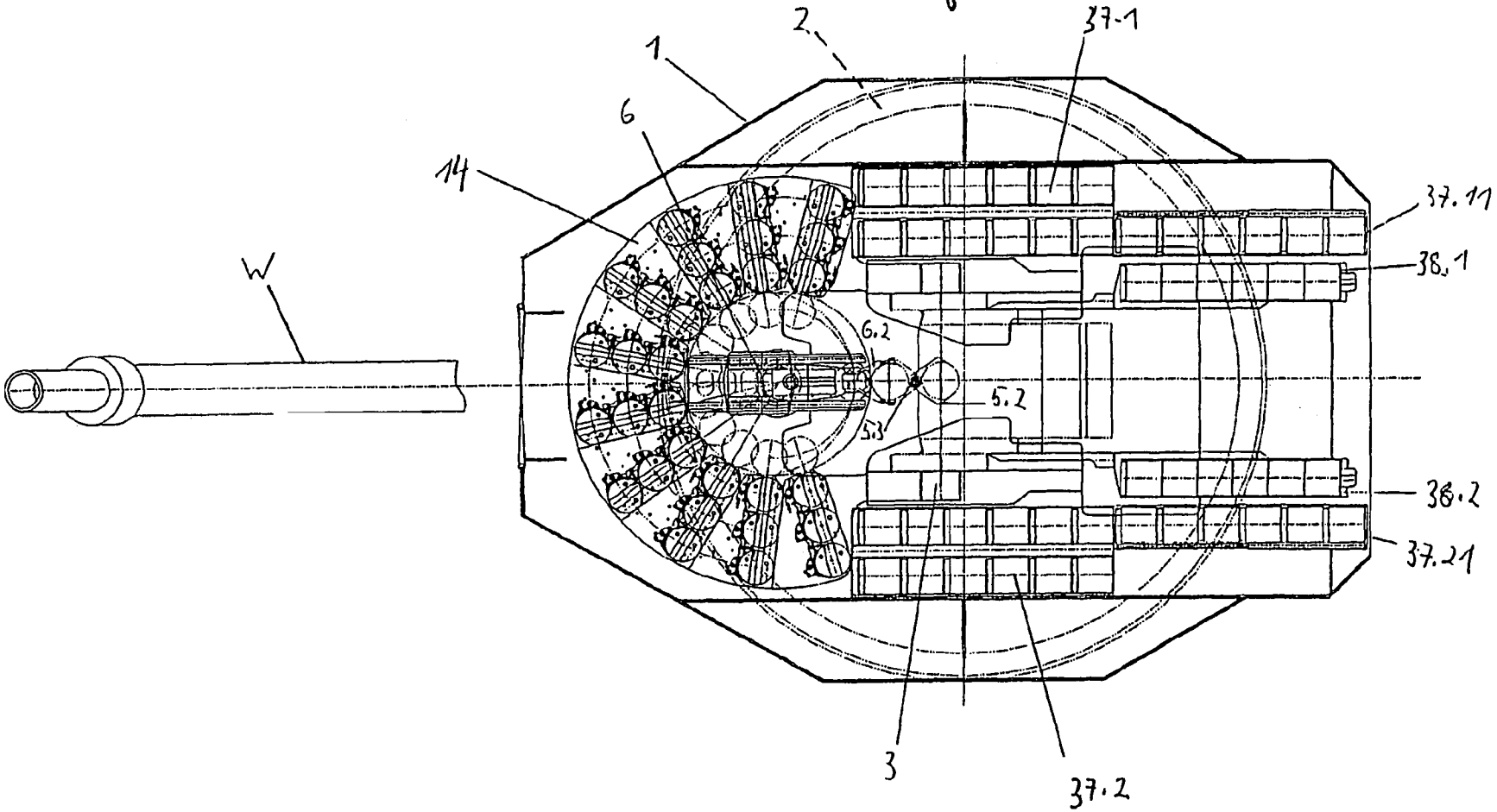
FIG. 11 a further embodiment of the firing module in a partially sectioned view from above, with ammunition magazines disposed in a star-shaped manner.
Figure 12:
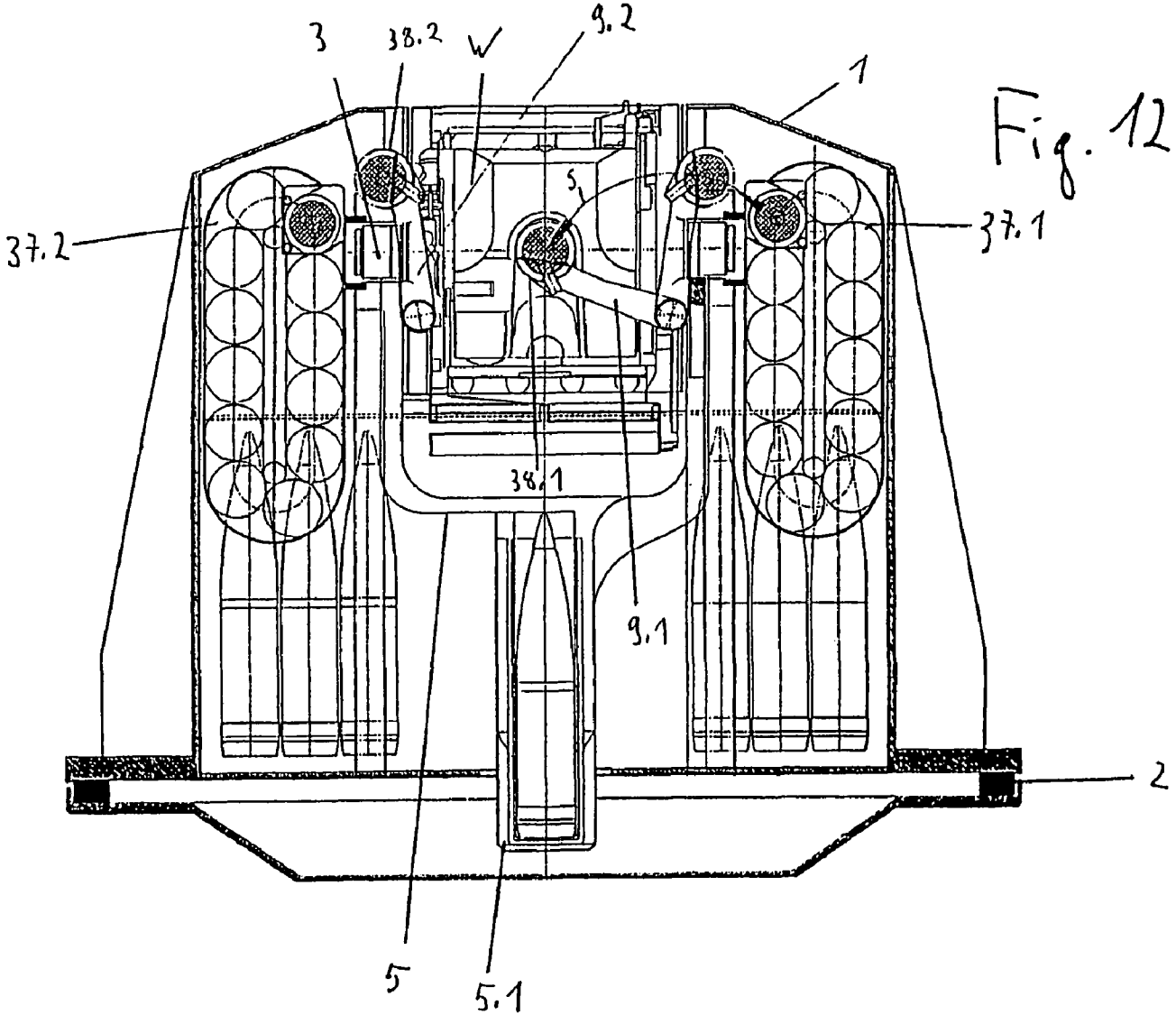
FIG. 12 a further embodiment of a firing module in a partially sectioned rear view with propellant charge magazines that are embodied as band magazines fixed to the weapon.

FIGS. 11 and 12 show a firing module where on the one hand the propellant charge magazines are embodied as band magazines 37.1 and 37.2 that are fixed on the weapon, and on the other hand a special, star-shaped arrangement of the ammunition magazine 14 exists. The propellant charge modules are supplied from the propellant charge magazines 37.1 and 37.2 to the propellant charge supply trays 38.1 and 38.2 via the apportioning stations 37.11 and 37.21, and the supply trays are pivoted inwardly behind the weapon in the manner previously described, and in particular via the pivot arms 9.1 and 9.2 on which are secured the propellant charge supply trays 38.1 and 38.2.

The pivoting-in of the propellant charge modules behind the weapon can be seen from FIG. 12. In FIG. 12, the pivot arm 9.1 with the propellant charge supply tray 38.1 is indicated in both positions, and in particular in a receiving position in the region of the upper end of the propellant magazine 37.1, and in a delivery position behind the weapon W. In this connection, the propellant charge supply tray 28.1 moves in the direction of the arrow S out of the receiving position into the delivery position. In other respects, the embodiment of FIGS. 11 and 12 has the same construction as does the embodiment of FIGS. 1 to 6.

The invention claimed is:

1. A firing module, comprising:

a housing mountable on a carrier structure so as to be rotatable in azimuth;

a heavy weapon mounted in said housing so as to be pivotable in elevation about a trunnion;

a shell supply mechanism that operates fully automatically for supplying shells to said weapon, wherein said shell supply mechanism is provided with a shell transfer arm that is pivotably mounted on said trunnion, wherein a shell ram having a loading tray is disposed on a free end of said shell transfer arm, and wherein said shell transfer arm is pivotable between a raised position, in which said loading tray is aligned with a gun bore axis of said weapon, parallel to a plane of elevation, and a lowered position, in which said loading tray is essentially vertical;

a shell transporter having a shell transport arm, on a free end of which is provided a gripping mechanism for grasping a respective shell that is vertically stored in at least one ammunition magazine, tip pointing upwardly, and for supplying said shell from said shell transporter, to said loading tray, in said lowered position of said shell transfer arm, wherein said at least one ammunition magazine and said shell transporter are disposed in said housing in a region ahead of said trunnion, and wherein said loading tray, on said shell transfer arm, is pivotable about a pivot axis, which in said lowered position of said shell transfer arm is essentially vertical, by at least 180° between a receiving position, which opens to a region ahead of said trunnion, and a delivery position, which opens to a region behind said trunnion;

at least one propellant charge magazine disposed in said housing in a region next to or behind said trunnion; and a propellant charge supply mechanism that operates fully automatically and is disposed in said housing for supplying propellant charges to said weapon, wherein said propellant charge supply mechanism is provided with a propellant charge supply tray; having a propellant charge ram, and wherein said propellant charge supply tray is pivotable into a region behind said weapon and in alignment with said gun bore axis of said weapon.

2. A firing module according to claim 1, wherein said at least one propellant charge magazine is fixedly disposed on said housing, wherein said propellant charge supply mechanism is provided with at least one propellant charge transfer arm that is pivotably mounted on said trunnion and on a free end of which are disposed said propellant charge supply tray and said propellant charge ram, and wherein said propellant charge transfer arm is pivotable between a receiving position, in which propellant charges can be supplied to said propellant charge supply tray, parallel to said plane of elevation, and a delivery position, in which said propellant charge supply tray, via a pivot arm, in a plane perpendicular to said gun bore axis of said weapon, is pivotable into a position that is in alignment with said gun bore axis of said weapon.

3. A firing module according to claim 1, wherein said at least one propellant charge magazine is secured to said weapon, wherein said propellant charge supply mechanism is provided with a propellant charge supply arm that is pivotable about an axis parallel to said gun bore axis of said weapon and on a free end of which iare disposed said propellant charge supply tray and said propellant charge ram, and wherein said propellant charge supply arm is pivotable between a receiving position, in which propellant charges can be supplied to said propellant charge supply tray, in a plane perpendicular to said gun bore axis of said weapon, and a delivery position, in which said propellant charge supply tray is aligned with said gun bore axis of said weapon.

4. A firing module according to claim 2, wherein said at least one propellant charge magazine is embodied for receiving propellant charge modules and is provided with devices for delivering a prescribed number of said propellant charge modules, which are adapted to be disposed one after another in said propellant charge supply tray.

5. A firing module dependent on claim 3, wherein said at least one propellant charge magazine is embodied for receiving propellant charge modules and is provided with devices for delivering a prescribed number of said propellant charge modules, which are adapted to be disposed one after another is said propellant charge supply tray.

6. A firing module according to claim 1, which includes two propellant charge magazines, and wherein a respective propellant charge supply mechanism is associated with each propellant charge magazine.

7. A firing module according to claim 1, wherein said at least one propellant charge magazine is embodied as a compartment magazine in which propellant charge modules are disposed one above the other in individual compartments, and wherein said propellant charge modules are adapted to be cyclically delivered from each individual compartment.

8. A firing module according to claim 1, wherein said at least one propellant charge magazine is embodied as a circulating band magazine in which propellant charge modules are stored on individually circulating bands, and wherein said propellant charge modules are adapted to be cyclically delivered from each band.

9. A firing module according to claim 1, wherein an apportioning station is disposed at each propellant magazine, wherein a desired number of propellant charge modules are delivered into said apportioning station from said at least one propellant charge magazine, and wherein said propellant charge modules are transferred from said apportioning station into said propellant charge supply tray.

10. A firing module according to claim 9, wherein, with the use of propellant charge modules that are placed in one another, a placing together of said propellant charge modules is effected is said apportioning station.

11. A firing module according to claim 1, wherein said shell supply mechanism and said propellant charge supply mechanism are provided with automatically controllable drive means and control means that are adapted to be controlled from an operating station disposed externally of said housing.

* * * * *